United States Patent [19]

Goetz

[11] Patent Number: 4,559,923

[45] Date of Patent: Dec. 24, 1985

[54] CERAMIC STOVE

[76] Inventor: Manfred Goetz, 7914 Turtle Valley Dr., Clifton, Va. 22024

[21] Appl. No.: 604,871

[22] Filed: Apr. 27, 1984

Related U.S. Application Data

[62] Division of Ser. No. 242,151, Mar. 9, 1981, Pat. No. 4,455,993.

[51] Int. Cl.[4] ..... F23J 11/00

[52] U.S. Cl. ..... 126/307 R; 126/82; 126/114

[58] Field of Search ..... 126/64, 66, 80, 81, 126/82, 83, 98, 307 R, 301, 302, 114, 115, 119

[56] References Cited

U.S. PATENT DOCUMENTS 407,707 7/1889 Utter ..... 126/82

4,177,791 12/1979 Marchant ..... 126/77

*Primary Examiner*—William E. Lyddane

*Assistant Examiner*—Gerald Anderson

*Attorney, Agent, or Firm*—William E. Mouzavires

[57] ABSTRACT

A ceramic stove that may be supplied in kit form includes a base frame, a cast iron firebox secured on the base frame, a top frame attached to and surrounding the top of the firebox, and ceramic panels extending between and held by the frames in spaced relation from the firebox. The ceramic panels are "ship-lapped" relative to each other and are not cemented or otherwise positively attached to each other. Logs may be fed as fuel into the fire box door from one side of the stove allowing longer logs to be burned. The logs rest on a grate which includes a "shakable" portion for shaking ashes onto an ash pan located below the grate. A separate, small door into the firebox is provided for starting the fire and that door is covered by another, safety door which also closes the space through which the ash pan is removed for emptying. An outer screen gate is provided to overlie the firebox doors and the entire side of the firebox. Products of combustion rise in the firebox and are guided by a baffle in a desired serpentine path prolonging their containment, until they reach an outlet at the top of the fire box where they are then carried downwardly by a flue formed in part by a portion of the back wall of the firebox. A heat shield covers the back wall of the firebox including the flue whose outlet extends through the heat shield at mid elevation. Other features and advantages are also disclosed.

7 Claims, 9 Drawing Figures

CERAMIC STOVE

This is a division of application Ser. No. 242,151, filed Mar. 9, 1981, now U.S. Pat. No. 4,455,993, the entire disclosure of which is incorporated herein by reference.

BACKGROUND OF INVENTION

Energy conversion has spurred, among a wide variety of heat-saving devices and inventions, a widespread development and revitalization of the wood stove. In American today, there are literally hundreds of different brands of wood stoves on the market to choose from, all with claims to some heat-saving feature. Most of these stoves are made from cast iron or sheet metal or some combination of the two. However, there are a small number of stoves that include cemented ceramic tiles as their outer surfaces for collecting and radiating heat. Ceramic tiles have the distinct advantage over cast iron or steel plate of retaining heat longer, while being safer to touch without incurring a burn. Ceramic tiles are also believed in some quarters to be more decorative and easier to clean than their counterpart, cast iron or sheet metal stove surfaces. However, in the past ceramic stoves have been more costly to manufacture than metal stoves, and this, together with the lack of technology development of ceramic stoves in America, may account for their little presence in America.

OBJECTS OF INVENTION

The present invention provides a new and improved ceramic stove, as well as a method of constructing and assembling the same. The present invention also provides, as an article of manufacture, a kit for constructing a ceramic stove.

Another object of the present invention is to provide a ceramic stove that may be manufactured at a cost comparable to that of metal stoves and yet, will perform at least as well, if not better, than metal stoves. Included herein is the provision of a ceramic stove that may be supplied to the end user or consumer as a kit that may be easily assembled without special skills or tools.

Another object of the present invention is to provide a wood or coal burning stove preferably of the ceramic type that will be extremely efficient in its heat output measured against its energy consumption. Included herein is such a stove that is also very efficient from the standpoint of supervision and maintenance.

A further object of the present invention is to provide a stove described above that may be used with the chimney of an existing fireplace or any other industryapproved smoke stack. Included herein is such a stove that may be positioned closer to a wall than many conventional stoves and without violating existing building or safety codes.

A still further object of the present invention is to provide a stove that may be constructed with a ceramic panel facing that may be provided in various selectable colors and designs that will be highly functional as well as decorative and pleasing to the eye.

Yet another object of the present invention is to provide a stove that may be constructed in one of several different modes to select as desired, the position of the flue or the position of the doors into the firebox, thereby increasing the locations in a room at which the stove may be positioned for operation. Included herein is the provision of a ceramic-faced stove that may be fed with logs of relatively long length by virtue of the location of the door into the firebox on one side of the stove so that the direction of feeding the logs coincides with the longitudinal dimension of the firebox chamber.

Yet another object of the present invention is to provide a stove that is extremely safe and easy to start, operate and maintain and will further give dependable service over long periods of continuous use.

SUMMARY OF PREFERRED EMBODIMENT OF THE INVENTION

The inventive concepts of the present invention are embodied in a stove including a firebox secured on a base frame. Spaced in generally parallel planes from the wall of the firebox are a plurality of vertical heat panels, preferably ceramic panels, which define, with the firebox, air passages permitting cool air to enter into the passages below the stove and to exit as heated air above the stove. The ceramic panels rest on the base frame and extend upwardly therefrom the full height of the firebox as single pieces terminating at their upper ends which are held by a top frame surrounding the firebox and secured thereto. The base and top frames are shaped and provided with stops to hold the ceramic panels in position.

The ceramic panels have a novel shape along their opposite edge portions allowing them to be ship-lapped relative to each other but no cement or other fasteners are utilized to positively attach the panels to each other. The lapping of the panels also prevents air leakage therethrough while also allowing the panels to be adjusted along the length or width of the stove into proper position during assembly.

The ceramic heat panels cover the entire front of the stove and one side thereof in the preferred embodiment so that they provide a large surface area which radiates heat collected in the panels. The other side of the stove contains a safety gate behind which a fuel-loading door on the firebox closes access to the combustion chamber. Below the fuel-loading door is a safety door which covers a small door opening into the lower section of the combusion chamber for purposes of giving access for safely starting a fire while the loading door is closed. The safety door also covers an opening in the bottom of the firebox through which an ash pan may be withdrawn from or inserted in the firebox.

At the back of the stove spaced from the firebox, is a metallic heat shield through which, at its mid portion, is located the outlet of a flue which is formed by a pan-like structure mounted against the back wall of the firebox between the latter and the heat shield.

Logs or coal or other similar fuel rest on a grate in the lower end of the firebox above the ash pan. The grate includes a manually oscillatable member for shaking ashes into the underlying ash pan.

The firebox chamber is lined with fire brick which are interlocked during assembly to maintain them in place without requiring any cement. Smoke and other products of combustion rise in the firebox in a serpentine manner due to a baffle which extends across an upper portion of the firebox chamber. The smoke and products of combustion exit from an upper portion of the firebox into the aforementioned flue which directs the smoke downwardly along the back wall of the firebox in front of the heat shield where it then leaves, at a lower elevation, through a stack which may rise in a chimney of an existing fireplace or which may lead to external areas.

The top of the stove is provided with a grill or grate which rests on the top frame above the top wall of the firebox. The stove may be supplied in kit form for assembly by the homeowner or other consumer. Also, the stove may be assembled to place the firebox doors and/or flue in one of several different positions depending on the dictates of the room or the location of the smoke stack.

DRAWINGS

Other objects and advantages of the present invention will become apparent from the following more detailed description taken in conjunction with the attached drawings in which.

DETAILED DESCRIPTION

Figure 1:
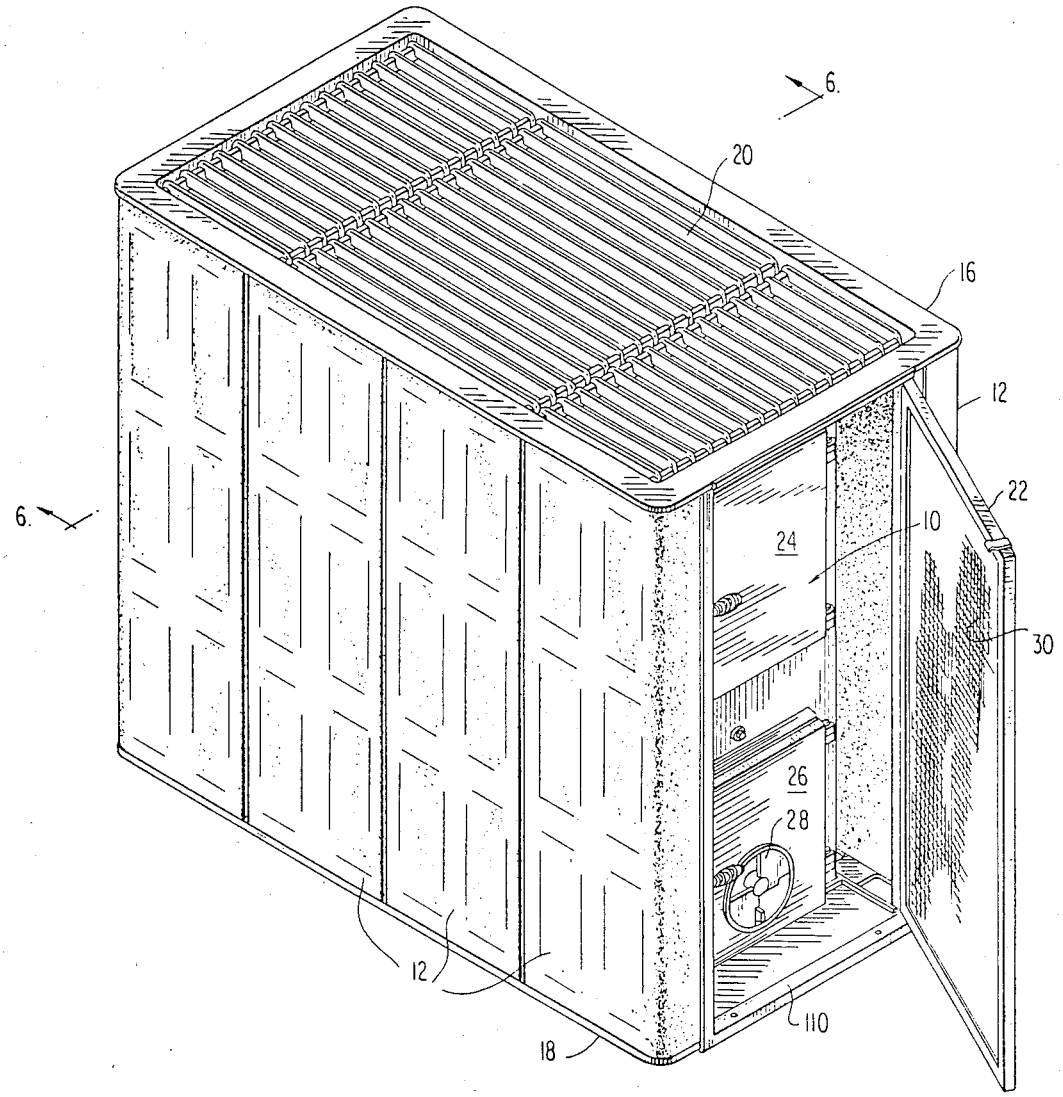
FIG. 1 is a perspective view of a ceramic stove embodying the present invention and shown with its outer, safety gate in open position.

Referring now to the drawings in detail, there is shown for illustrative purposes only in FIG. 1, a ceramic stove constituting a preferred embodiment of the invention. Basic parts of the stove include a firebox generally designated 10 which is covered on its front side by heat panels, preferably ceramic panels, generally designated 12. The backside of the firebox 10 is covered by a heat shield generally designated 14 (see FIG. 8); the ceramic panels 12 and the heat shield 14 being spaced from the firebox to provide air passages as will be described. On one side of the firebox is located a safety gate 22 which gives access to a fuel-loading door 24 in one side of the firebox and a safety door 26 located below the fuel-loading door 24; the safety door 26 covering a small door (not shown in FIG. 1) through which the fire is started, and an opening for removal of an ash pan (not shown in FIG. 1) as will be described. The side of the firebox opposite the safety gate 22 is covered with ceramic panels 12*a* and 12*b* (see FIG. 8) similar to those that appear in FIG. 1. Although shown with a metallic screen 30, safety gate 22 may be constructed with ceramic panels to enhance the heat radiation of the stove.

Figure 2A:
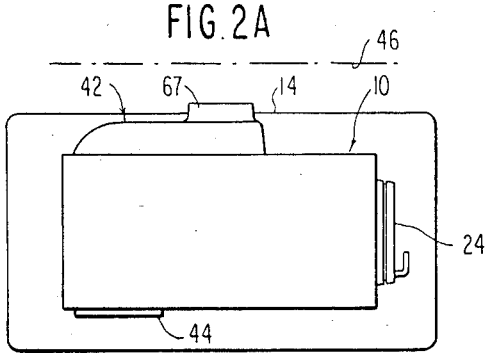
FIG. 2A is a diagrammatic plan view of the stove showing one arrangement for locating the doors in the firebox and the flue.
Figure 2B:
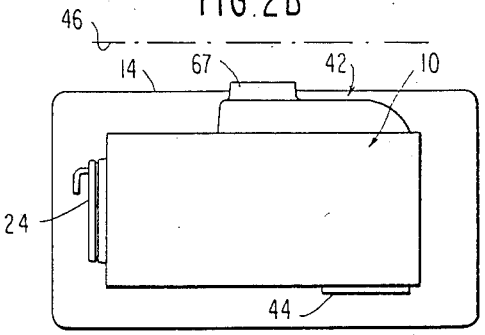
FIG. 2B is a view similar to FIG. 2A except that it shows another arrangement for locating the firebox doors and the flue.

The longitudinal extent of the firebox 10 is shown in FIG. 2A where it is seen that the fuel-loading door 24 is positioned on the right, as viewed in FIG. 2A, in alignment with the longitudinal dimension of the fire box, thereby permitting logs of relatively long length to be inserted into the firebox. FIG. 2A also shows a flue generally designated 42 which extends in the space between the back wall of the firebox and the heat shield 14. Instead of being located, as shown in FIG. 2A, the flue 42 could have been positioned on the opposite side of the firebox in which case the closure 44 would be removed to provide a port for communicating with the flue 42. FIG. 2B shows an arrangement opposite that shown in FIG. 2A for locating the firebox doors and the flue. In both views, FIGS. 2A and 2B, the numeral 46 designates a nearby wall.

FIREBOX WALLS

Figure 3:
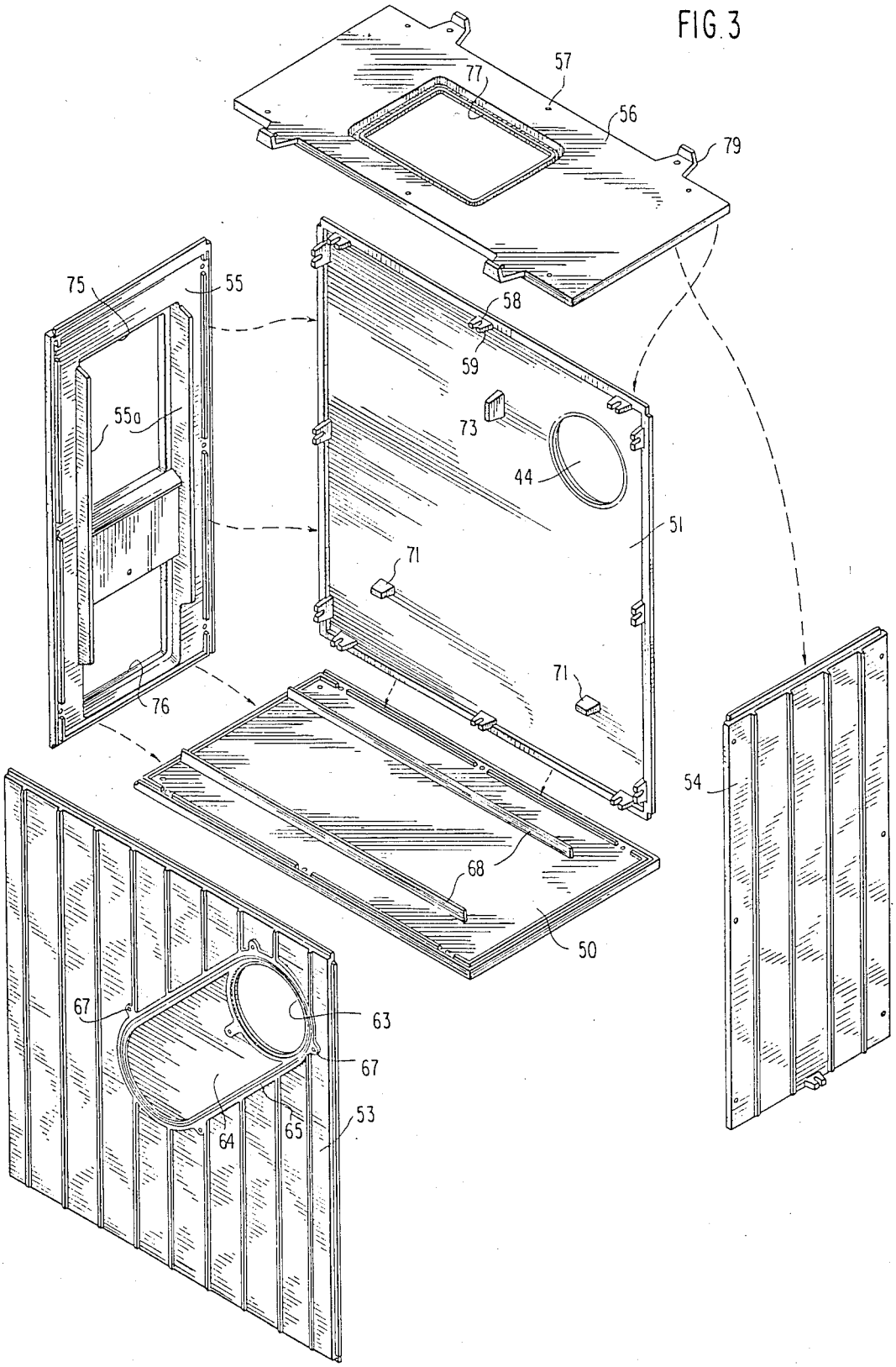
FIG. 3 is an exploded, perspective view of the firebox included in the stove and with certain portions of the firebox omitted.
Figure 6:
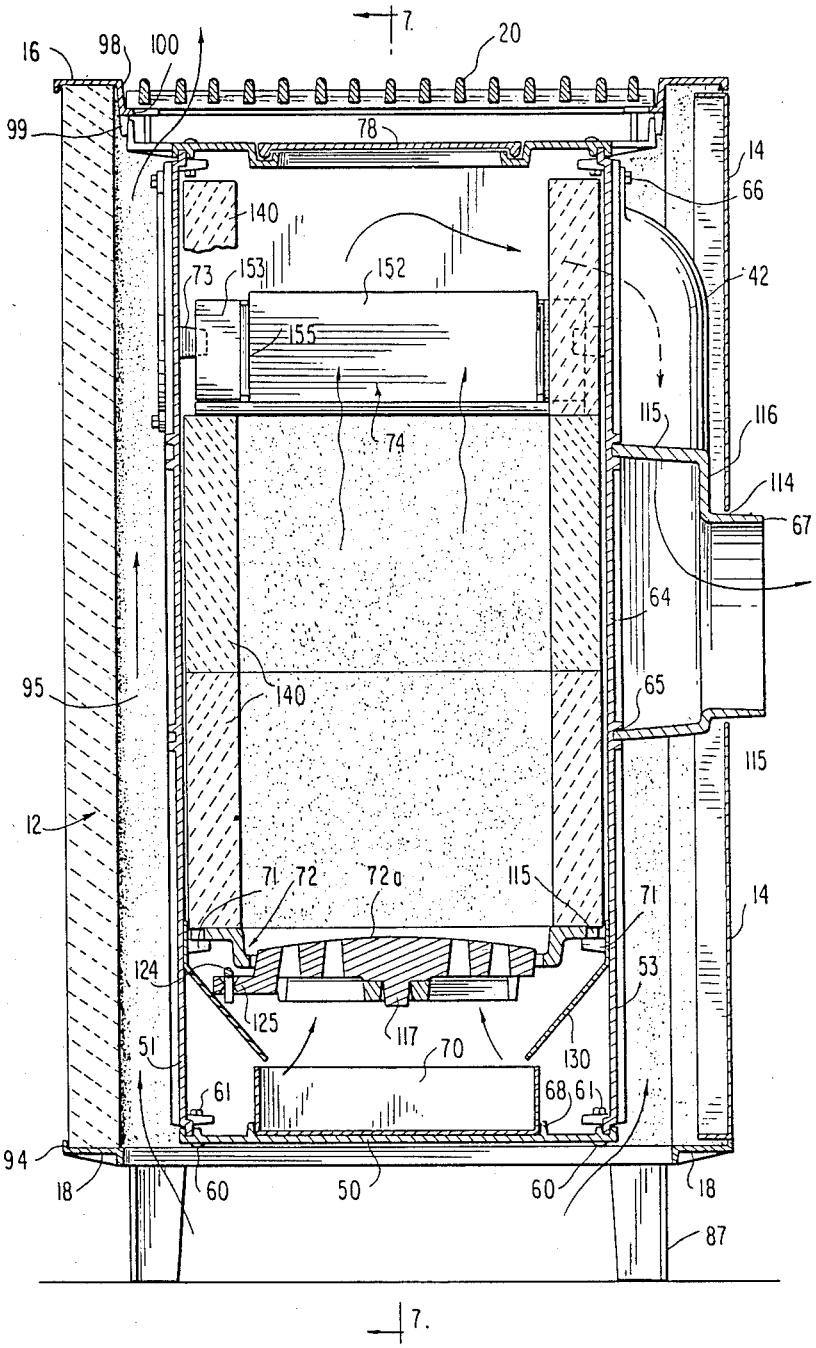
FIG. 6 is a cross-sectional view of the stove taken along a plane transverse to the longitudinal dimension of the stove.

Referring now to FIG. 3, the firebox includes a generally rectangular box-like construction including a base wall 50, upstanding front and rear walls 51 and 53, opposite side walls 54 and 55 and a top wall 56, all of which have a generally rectangular shape and are made preferably from cast iron. As seen in FIG. 3, the edge portions of the fire box walls are provided with matching interfitting tongues and grooves for facilitating assembly. Once assembled and sealed, the firebox walls are positively secured in place by means of bolts received through apertures such as 57 in the top-wall 56 and slots in lugs, such as slots 58 in lugs 59 shown in FIG. 3. The bottom portion of FIG. 6 shows, by way of example, bolts 60 and nuts 61 utilized to secure the base wall 50 of the firebox to the opposite front and rear walls 51, 53. Although not shown, any suitable sealant is inserted in the grooves along the mating edge portions of the fire box walls prior to securing the walls in place.

Figure 4:
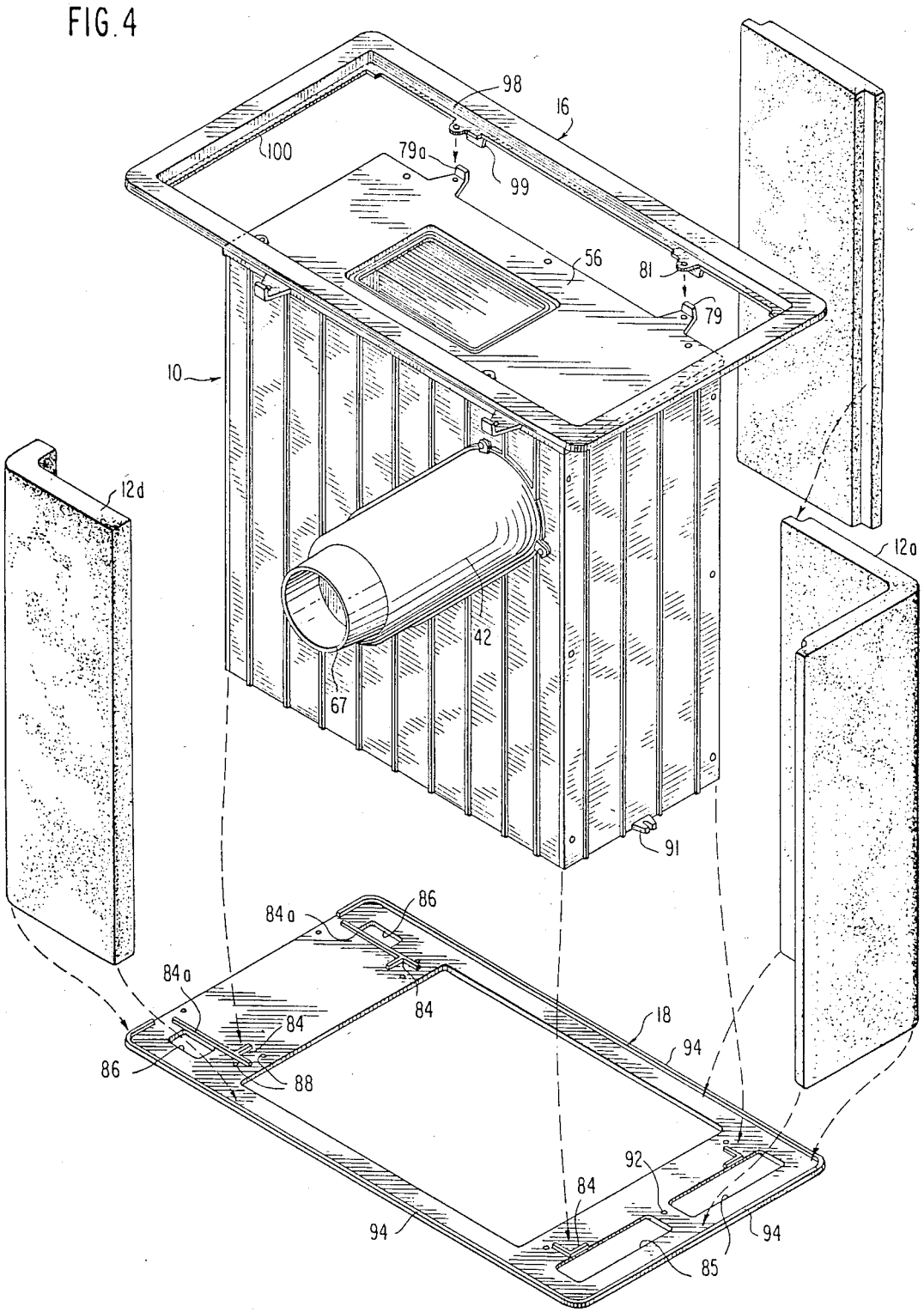
FIG. 4 is an exploded, perspective view of top and bottom frame portions and ceramic panels of the stove shown in relation to the firebox which is shown assembled.
Figure 8:
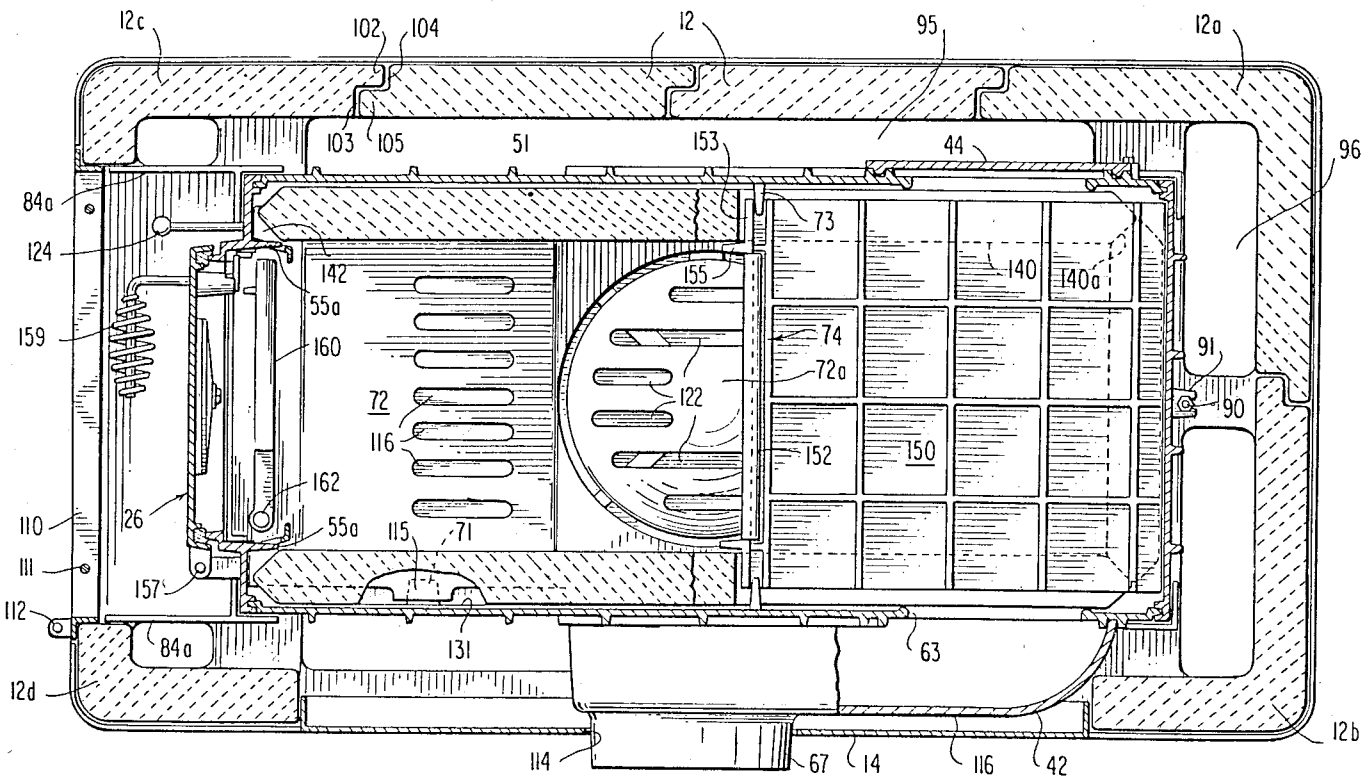
FIG. 8 is a cross-sectional view taken generally along lines 8—8 of FIG. 7.

Continuing now with reference to FIG. 3, there is shown the closure 44 covering a circular exhaust port in the front wall 51 of the firebox which is not to be used in the specific embodiment shown. If it were desired to locate the flue in the wall 51, the closure 44 would be removed and placed over the exhaust port 63 in the rear wall 53 of the firebox. The outer surface of rear wall 53 is provided with a ribbed construction for reinforcement purposes. However, a portion of the outer surface of the rear wall 53 is smooth and non-ribbed at 64 to indicate the location of the flue 42 (not shown in FIG. 3). Referring to FIG. 6, together with FIG. 3, it will be seen that rear wall 53 of the firebox is grooved at 65 for receiving the edges of the flue 42 which is positively secured to the rear fire box wall 53 through means of bolts or screws 66 extending through apertures 67 formed in wall 53. Flue 42 has a generally pan-like construction, the open side of which faces the non-ribbed wall portion 64 of the firebox wall 53 so that the flue duct is formed in part by fire box wall portion 64 and the remaining part by pan structure 42. The outlet of the flue 42 is at 67 as shown in FIGS. 2A, 6 and 8, the outlet leading to a stack which may be in a chimney (not shown) or simply a stack which leads to an external area. FIG. 4 shows the flue 42 as assembled on the back wall of the firebox.

Figure 7:
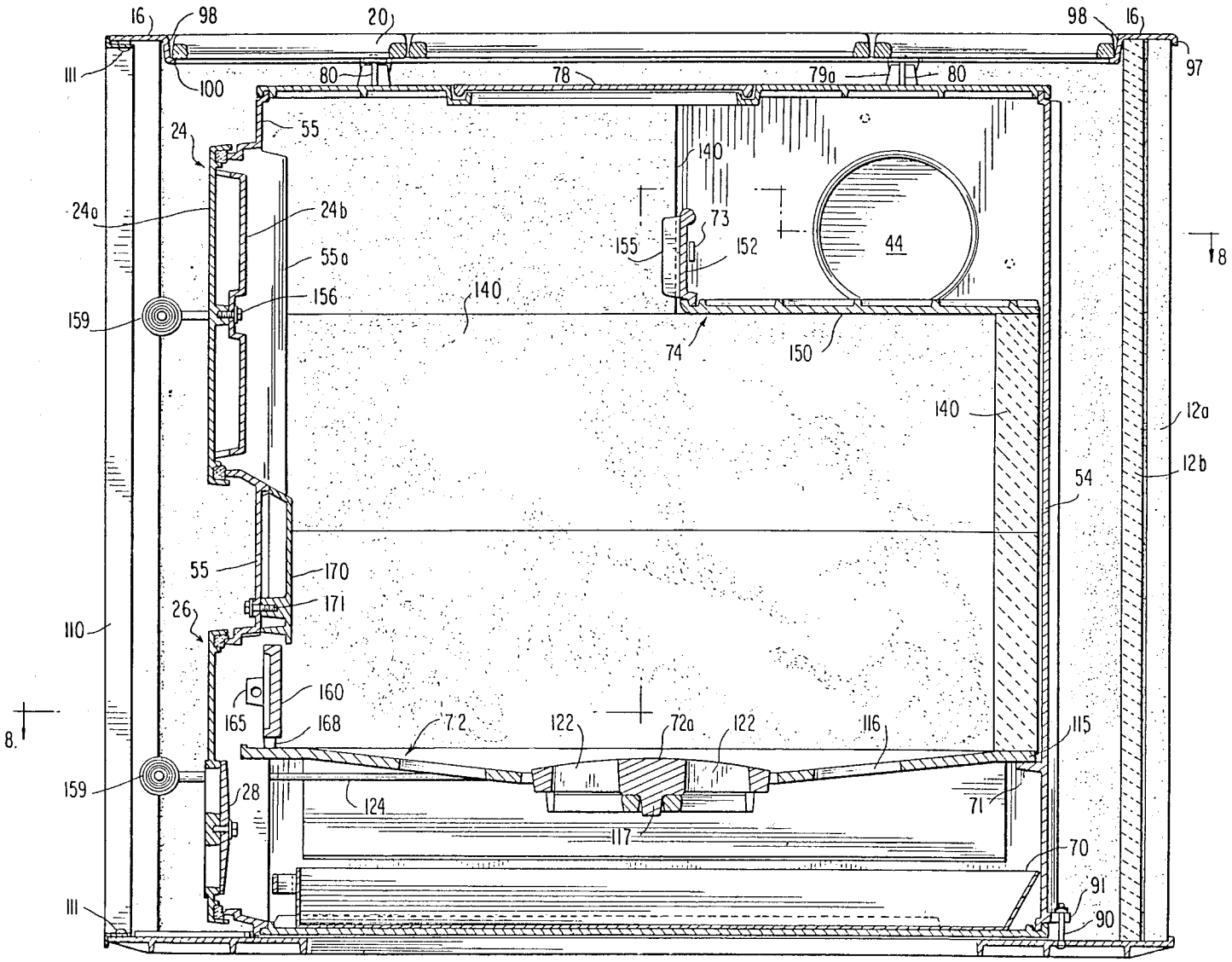
FIG. 7 is a cross-sectional view taken generally along lines 7—7 of FIG. 6.

Returning now to FIG. 3, bottom wall 50 of the firebox includes a pair of upstanding fixed parallel ribs 68 forming guides for receiving and guiding an ash pan 70 which is shown in FIGS. 6 and 7.

Lugs 71 on the front and back firebox walls 51, 53 as shown in FIG. 3, are used for supporting a grate generally designated 72 and shown in FIGS. 6, 7 and 8. Firebox walls 51 and 53 also have additional lugs 73 for locating and holding a baffle 74 in position as will be described, the baffle being shown in FIGS. 6 and 8 together with lugs 73.

As shown in FIG. 3, side wall 55 of the firebox is formed with openings 75 and 76 which are to be closed by firebox doors 24 and 26 shown in FIG. 1. Side wall 55 also has a pair of elongated vertically extending flanges 55*a* on its inner side for holding fire brick as will be described below.

Top wall 56 of the firebox is provided with an opening 77 for receiving a pressure relief plate 78 shown in FIGS. 6 and 7. Referring to FIGS. 3 and 4, top wall 56 of the firebox is provided on its opposite sides with pairs of L-shaped mounting and securing lugs 79 having apertures for receiving bolts 80 (see FIG. 7) which pass through apertures in mounting lugs 81 formed along the inner edge of the top frame 16 (see FIG. 4). Lugs 79 on the top wall of the firebox and lugs 81 on the top frame also serve to locate the top frame relative to the firebox in the proper position during assembly. All of the parts of the firebox walls described above are cast integral with the walls.

BASE FRAME

After the firebox walls are assembled together, and the flue 42 is secured in place on the back wall 53 of the firebox as shown in FIG. 4, the firebox may then be mounted on the base frame 18. In the preferred embodiment, as shown in FIG. 4, base frame 18 has a generally rectangular outline and includes a large rectangular opening 83 which underlies the base 50 of the firebox. During assembly, firebox 10 is located on base frame 18 by means of cornershaped recesses formed by the lugs 84 corresponding to the four corners of the firebox; the lugs 84 having a right angle shape and preferably being integrally cast with the frame 18. Additionally, base frame 18 has a pair of upstanding lugs 84*a* for purposes of locating corner portions of the heat panels 12*c* and 12*d* to be described. On the opposite ends of base frame 18 are formed air ports 85 and 86 for purposes of admitting cool air upwardly through space between the ceramic heat panels 12 and the firebox 10 as will be further described. In order to support the stove from a floor surface, suitable legs 87 (see FIG. 6) are attached to the four corner portions of the base frame 18 through means of bolts passing through apertures 88 provided in the base frame 18 as shown in FIG. 4.

Once the firebox 10 is assembled on the base frame, it is secured in place by means of a bolt 90 (see FIGS. 7 and 8) passing through an aperture 92 in the base frame 18 (see FIG. 4) and a slot in a lug 91 projecting from firebox wall 54. In addition, the base wall 50 of the firebox is provided with apertures 7 for receiving bolts for securing the base 50 of the firebox to the bottom frame 18.

HEAT PANELS

As will be apparent from the description below, heat from the firebox is utilized to heat a plurality of heat panels 12 which, in the preferred form, are made from ceramic material. However, other materials such as soap stone or other stones may be utilized as well. Ceramic panels 12 extend the full height of the stove or firebox and are spaced in parallel from the firebox walls to define air passages 95, 96 as shown in FIGS. 6 and 8. Note that the ceramic panels 12 extend the full height of the firebox as a single piece, but the decorative effect imparted to the surface of the panels 12, as indicated in FIG. 1, gives the impression that there are a plurality of vertically spaced tiers of smaller ceramic tiles. Any desired ornamental effect may be imparted to the outer surface of the tiles 12 which are preferably glazed. For example, instead of a planar surface, the surface may be formed with depressions or projections. Any colors may also be utilized in forming the surface of the ceramic panels. In the preferred embodiment shown, ceramic panels 12 cover the entire front of the stove as shown in FIG. 1, and also cover one side of the stove which is positioned opposite the safety gate 22 which covers the doors into the firebox. As mentioned above, and although not shown, gate 22 could also incorporate, if desired, ceramic panels so that the opposite sides of the stove would be covered completely by ceramic surfaces. Additionally, and although not shown, the back of the stove may be covered with ceramic panels instead of the heat shield 14 shown. Thus, it is possible to construct the stove with ceramic panels on all of its sides. As shown in FIGS. 4 and 8, the ceramic panels include corner pieces 12*a* and 12*b* which extend about the corners of the stove to provide surface portions on the front and back of the stove as well as on the side of the stove. The same is true with the panels 12*c* and 12*d*.

Ceramic panels 12 are supported on the bottom frame 18 where they are positioned and held against outward movement by means of a vertical upstanding flange or lip 94 formed about the periphery of the bottom frame 18 as shown in FIGS. 4 and 6. At their upper ends, ceramic panels 12 are held by the top frame 16 which has a depending flange or lip 97 along its outer edge for containing the upper end portions of ceramic panels 12 as perhaps best shown in FIG. 6. As shown in FIG. 4, top frame 16 also has a depending inner flange 98 extending throughout which serves to contain the ceramic panels against inward movement at their upper ends, see also FIGS. 6 and 7. In addition, as shown in FIGS. 4 and 6, lugs 99 are provided on the top frame 16 to depend vertically downwardly from its inner flange 98 to further contain the upper ends of ceramic panels 12. Inner flange 98 of top frame 16 also contains a horizontal lip 100 for supporting the grill 20 mentioned above.

It will be seen from FIG. 8, that ceramic panels 12 are not cemented or otherwise positively attached to each other but rather, they are merely ship-lapped at their opposite longitudinal side edge portions. In the preferred embodiment, the mating or overlapping longitudinal side edge portions are provided with a generally stepped shape including, for example with reference to panel 12*c*, a tongue portion 102 and a groove portion 103. The adjacent panel has a complementary tongue and groove portion including groove 104 which receives tongue 102, and tongue 105 which is received in groove 103. The ship-lapping of the ceramic panels prevents any substantial air leakage from the air passages 95 and 96 that would obstruct the desired upward draft in the air spaces 95, 96 but also, and very importantly, allows the position of the panels 12 to be adjusted along their width dimension during assembly to ensure that the panels 12 extend continuously throughout the extent of the upper and lower frames 16 and 18 about the firebox as desired. The ship-lapped nature of the ceramic panels 12 further helps to secure them in place and also gives the visual impression of conventional tile cemented together along joints. Corner panels 12*c* and 12*d* at the one side of the stove adjacent the doors into the firebox, are located in proper position, not only by the flanges 97 and 94 of the top and bottom frames 16 and 18 but also, by the lugs 84*a* upstanding from the base of the bottom frame as shown in FIG. 4.

Additionally, secured between the top and bottom frames, is a rectangular frame 110 (also see FIG. 1) which is secured by screws or bolts 111 to the top and bottom frames 16 and 18. Rectangular frame 110 receives gate 22 which may be hinged to the former in any suitable manner, such as through the hinges 112 shown in FIG. 8. Although gate 22 is shown in FIG. 1 with a screen panel 30, if desired, it may incorporate ceramic heat panels.

FLUE

Referring to FIGS. 6 and 8, heat shield 14 is made from any suitable material, such as steel plate, in conformity with local building and safety codes. Heat shield 14 is secured in position by bolts to the upper and lower frames 16 and 18. As noted above, ceramic heat panels may be used instead of heat shield 14. Heat shield 14 contains a portal 114 for receiving the outlet 67 of flue 42 which is positioned between heat shield 14 and the back wall 53 of the fire box. Indeed, as described above, back wall 53 of the firebox forms a wall portion of the flue 42 with the remaining portion of the flue 42 being formed by a generally pan-like structure best shown perhaps in FIG. 6. This pan-like structure includes opposite side walls 115 projecting from a base 116 which has a portal formed by the outlet 67 described above as shown in FIG. 6. The upper end of the flue structure 42 communicates with the portal 63 in the back wall of the firebox as shown in FIG. 8 so that products of combustion including smoke which exit from the firebox combustion chamber at an upper portion thereof will be directed downwardly along a diagonal path through flue 42 as indicated by the arrows in FIG. 6. It will then exit from outlet 67 of flue 42. Enclosing flue 42 within the heat shield 14 safely removes the flue from inadvertent contact while, at the same time, utilizing the heat of the smoke and other products of combustion for heating the air in the space between heat shield 14 and the firebox. Moreover, the positioning of outlet 67 of the flue at a relatively low level allows the flue outlet to be connected to the chimney of an existing fireplace as well, of course, to any other stack which may lead to external areas. Concealment of flue 42 also improves the overall appearance of the stove.

GRATE AND ASH COLLECTION

Figure 5:
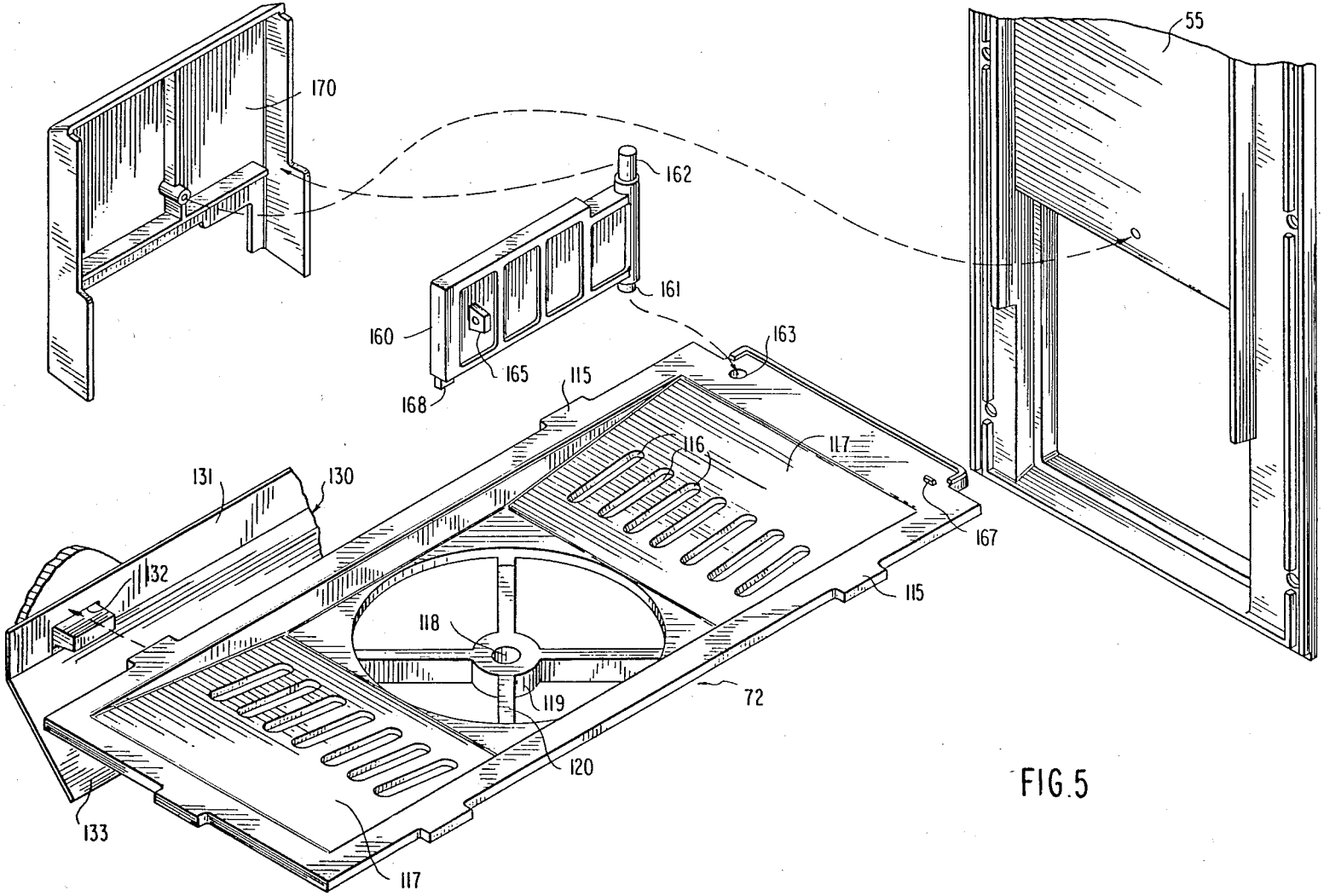
FIG. 5 is an exploded, perspective view of portions of the firebox including the grate.

Referring now to FIGS. 5 through 8, within the firebox combustion chamber at its lower end portion lies, in a generally horizontal plane, a grate generally designated 72. Grate 72 may be made from any suitable material such as cast iron, and extends throughout the full length of the fire box where it rests on lugs 71 projecting from the opposite walls 51, 53 of the firebox. Grate 72 is provided with outwardly extending tabs or flanges 115 which rest on lugs 71. As best shown in FIGS. 5 and 7, the opposite sections of grate 72 are provided with elongated slots 116 through which ash will fall into the ash pan 70 situated below the grate. Moreover, the opposite sections 117 of grate 72 slope downwardly towards the center section of the grate as best shown in FIGS. 5 and 7 in order to help direct the ash to the center of the grate which is formed by a separate piece 72*a* seen in FIGS. 6, 7 and 8. This portion of the grate which is shown as being circular in outline is "shakable" in oscillation about its central axis which is defined by a mounting and pivot pin 117 which is received in an aperture 118 in an underlying hub 119 which is unified with the grate proper 72 by means of radiating webs 120 as shown in FIG. 5. Thus, the shakable grate portion 72*a* rests on the underlying stationary grate portion 119, 120 where it is rotatable about pin 117 for purposes of moving the ash which will accumulate on its surface so that the ash will fall through slots 122 formed through the movable grate portion 72*a* as shown in FIGS. 7 and 8.

Oscillation of movable grate portion 72*a* for shaking the ash, is achieved by a manual actuating member in the form of an elongated rod 124 which has a vertically depending inner end portion fixed within an aperture formed in an underlying flange portion 125 of movable grate 72*a* as shown in FIG. 6. Actuating rod 124 extends horizontally along the longitudinal dimension of the grate as shown in FIG. 7 through an aperture in end wall 55 of the firebox to the exterior of the firebox as shown in FIG. 8, where it may be grasped and reciprocated to oscillate the grate 72*a* about its central axis passing through pivot pin 117 during which time the movable grate 72*a* will move relative to the underlying stationary grate 72 to facilitate the flow of ash through the apertures 122 as well as 116 in both of the grate portions.

Ashes falling through grates 72, 72*a* will be received in ash pan 70 as described above which underlies the grates for the full length of the firebox, as best shown in FIGS. 6 and 7. In order to confine the ash which falls from the grates to the ash pan 70, ash guides 130 in the form of downwardly extending sheet baffles are provided above the opposite sides of the ash pan 70 as shown in FIG. 6. Ash guides 130 may be made from any suitable sheet metal such as sheet steel, and include a vertical planar portion 131, referring to FIG. 5, having apertures 132 which receive lugs 71 on the opposite walls 51, 53 of the firebox which are also utilized to mount the grate 72. Ash guides further include a lower planar, depending, portion 133 which extends downwardly at an angle inwardly of the firebox and to the opposite sides of the ash pan for purposes of guiding the ash into ash pan 70. Ash baffles are held in proper position by virtue of their mounting on lugs 71 and also by virtue of the tabs 115 formed on opposite sides of the stationary grate 72, which tabs engage the vertical mounting portions 131 of the ash guides and maintain them against the adjacent wall of the firebox as best illustrated in FIG. 5.

FIREBOX LINING AND BAFFLE

Referring now to FIGS. 6, 7 and 8, the firebox above the grate 72 is lined with fire bricks 140 which cover the opposite side walls of the firebox above the grate and also a lower section of one of the end walls 54 of the fire box. Fire bricks 140 are stacked upon each other in three tiers as best shown in FIG. 6. They are held in position against movement by being interlocked with each other, see brick portions 140*a* in FIG. 8 and also by being held within a recess 142 formed by the side walls of the fire box and flanges 55*a* of the adjoining end wall of the firebox in which the firebox doors are located. Fire bricks 140 are therefore constructed with ends of V-shaped cross section for purposes of interlocking with each other as shown at 140*a* and also for purposes of facilitating receipt in the recesses 142 of the firebox.

In addition, the baffle 74 is employed to lock the fire brick 140 in place. Baffle generally designated 74 includes a horizontal portion in the form of a plate 150 formed from suitable material such as cast iron which is supported on the second layer of fire bricks 140 so as to extend between the opposite sides of the fire box. Horizontal baffle 150 also extends to the end wall 54 of the firebox, thereby blocking a direct path of smoke and products of combustion from the combustion chamber to the outlet 63 in the back wall of the firebox. Additionally, baffle 74 includes a vertically extending portion 152 in the form of a cast iron bar projecting upwardly from the unsupported edge of the horizontal baffle 150 as best shown in FIG. 7. The opposite ends 153 of baffle portion 152 are received against lugs 73 projecting from the opposite walls of the firebox as described above. On one side of the end portions 153, opposite lug 73, are located the end portions of fire bricks 140 in the third tier of bricks, thus securing the latter in place while, at the same time, securing the vertical baffle portion 152 in proper position. Note that the ends of the fire bricks at this juncture need not be V-shaped in cross section but may simply be planar in shape as shown in FIG. 8.

The lower longitudinal edge portion of vertical baffle 152 is received in a groove formed in the upper surface of horizontal baffle 150 as best shown in FIG. 7. In order to further secure the fire brick 140 in the third tier in place, vertical baffle 152 is provided with lateral lugs or flanges 155 which extend along inner surface portions of the fire bricks 140 to contain the same against movement inwardly of the firebox as best shown in FIG. 8.

It will be seen from FIGS. 6 and 8 that the outlet 63 of the firebox communicates with the space above the horizontal baffle 150. Thus, the smoke and products of combustion must travel about the vertical baffle 152 to the space above the horizontal baffle 150 in order to exit from the outlet 63, see the arrows in FIG. 6. Such circuitous travel prolongs the containment of heat in the firebox while promoting more complete combustion.

FIREBOX DOORS

Referring now to FIGS. 3 and 7, end wall 55 of the firebox as described above is provided with large openings 75 and 76 for the doors 24 and 26 into the firebox. The fuel-feeding door, generally designated 24, is hinged at 157 (see FIG. 8) relative to the firebox end wall 55 and includes outer and inner spaced sections **24*a* and 24*b* secured together by bolt 156 as illustrated in FIG. 7. Below fuel-feeding door is another, safety, door 26 suitably hinged relative to end wall 55 for closing or opening the large opening 76 in the lower section of the firebox end wall 55. In its upper section, door 26 covers a small generally rectangular door 160 which is utilized for starting the fire in the firebox. In addition, the lower section of door 26 covers the opening through which ash pan 70 may be removed for emptying and replaced into the stove. The lower section of safety door 26 is also utilized to mount a rotatably adjustable air vent or damper 28. Coil safety handles 159 are utilized for opening and closing the doors 24 and 26**.

Referring now to FIGS. 5, 7 and 8, the small door 160 for lighting the stove has an integral hinge pin, including a lower portion 161 which is received in aperture 163 formed in the stationary grate 72. The upper portion 162 of the hinge pin is contained in a passage formed in a wall section 170 which is secured to the inner surface of the firebox end wall 55 by bolt 171. Wall section 170 reinforces the end wall of the firebox while providing an air space for minimizing distortion due to excessive heat. The same is true with respect to the inner section **24*b* of the fuel-feeding door 24. Door 160 may be grasped by the small tab 165 for opening it or closing it, and a stop 167 is provided on grate 72 for engagement with a depending lug 168 on door 160 (see FIG. 5) to define the closed position of the door 160**.

ASSEMBLY STEPS

It will be seen from the above description that the stove of the present invention may be provided to the consumer in kit form, either with or without the fire box walls already assembled. In one kit form, the firebox walls 51, 53, 54, 55 are already assembled to the bottom wall and with the doors 24, 26 in place but with the top wall 56 of the firebox unassembled. In assembling the remaining parts, the legs 87 of the stove are secured by bolts fastened in apertures 88 of the bottom frame 18 (see FIGS. 4 and 6) after which the firebox may be placed on the bottom frame 18 and secured thereto through means of bolts passing through apertures 7 in the bottom wall 50 of the firebox (see FIG. 3). As described above, the location of the firebox on the base frame is facilitated by the raised, right-angle, corner lugs 84 on the base frame as shown in FIG. 4. In addition, the firebox is secured to the base frame by means of the bolt 90 passing through the base frame and the slot in lug 91 of the firebox (see FIGS. 7 and 8).

Grate 72 may then be inserted through the top opening in the firebox into position on lugs 71; however, prior to that step, the ash guides 130 must be placed into position with the lugs 71 of the firebox walls projecting through the apertures 132 in the guides. Thus, when grate 72 is installed, the ash guides will be fixed in place against movement by the lugs 115 of the grate.

Fire bricks 140 may then be installed through the top of the firebox and interlocked in place with each other and behind the flanges **55*a* of the firebox end wall 55. Also as described above, the baffles 150 and 152 are installed to further hold the fire bricks in place. The top of the firebox may then be closed by assembling the top wall 56 by bolts passing through apertures 57 in top wall 56 and slots 58 in lugs 59 shown in FIG. 3. The flue pan 142 may then be installed on the back wall 53 of the firebox by inserting the bolts 66 through the apertures 67 in the firebox wall 53**.

Ceramic panels 12 may then be installed by placing them on the ledge of the base frame 18 within the upturned lip 94 about the perimeter of the base frame 18. The lapping of the panels 12 will provide a tolerance permitting the panels to be adjusted into proper position. Top frame 16 may be then positioned on the top of the firebox and with the upper ends of the ceramic panels 12 received between the downturned lip 97 along the outer perimeter of top frame 16 and the internal flange 98. The top frame 16 may then be secured by bolts 80 passing through the apertures in the lugs 81 of the top frame and through the apertures in the lugs 79 of the firebox, see FIGS. 4 and 7. In this step, the vertical lug portions **79*a* will properly space the top frame 16 above the firebox top wall 56. Additionally, the depending lugs 99 along the inner flange of the top frame 16 will engage behind the upper ends of ceramic panels 12** to hold them in place against inward movement.

The heat shield 14 may then be installed between the upper and lower frames with the outlet 67 of the flue passing through the opening 114 of the heat shield 14. The grill 20 may then be placed within the inner flange 98 and on lip 100 of the top frame 16. The outer screened gate 22 of the stove with its surrounding frame 110 may then be installed between the upper and lower frames 16 and 18 and secured thereto by means of bolts 111 (see FIG. 7). The firebox safety door 26 may then be opened and the ash pan 70 slid between the guides 68 on the bottom wall 50 of the firebox to thus complete the assembly.

Because of the relatively low level of outlet 67 of flue 42, the flue may be connected to a chimney of an existing fireplace. In the alternative, the outlet 67 may be connected to a stack leading to an external area.

If instead of assembling the stove with the firebox doors on the right as viewed in FIG. 2A, the stove may be assembled to place the firebox doors on the left as viewed in FIG. 2B. Similarly, the flue 42 may be relocated on the opposite side as viewed in FIG. 2B. In addition, if desired, the flue may be moved (not shown) to the opposite side of the firebox by removing the closure 44 and applying it to the outlet 63. The above greatly increases the versatility of the stove enabling it to be used in various room arrangements. In another form of a kit according to the invention, the stove may be supplied to the consumer with the firebox completely assembled with all of its internal and external parts. All that would remain to be assembled would be the upper and lower frames 16, 18 to the firebox, the heat panels 12, and the upper grill 20.

In use, relatively long logs may be inserted into the combustion chamber of the firebox through the loading door 24 which faces the longitudinal direction of the firebox. After the firebox is loaded, door 24 is closed and then safety door 26 may be opened giving access to the small door 160 which may then be opened to give access to the firebox for starting the fire. Once the fire is started, the small door 160 is of course closed and then safety door 26 is closed and the air vent 28 may be adjusted to the desired position. The outer safety gate 22 may then be closed.

The smoke and other products of combustion will be prevented from moving directly to the outlet 63 of the firebox by means of the baffles 150, 152 which will cause the products of combustion to move in a serpentine path over the vertical baffle 152 and then into the space above the baffle 150 where it will then exit through port 63 into the flue 42 where it will then be led downwardly along the back wall of the firebox to the outlet 67. The heat from the firebox will heat the ceramic panels 12 which will, in turn, radiate heat into the surrounding space, and it will be seen that the large surface area of the ceramic panels will provide maximum heat without imposing any danger. In addition, cool air will enter from below the stove passing through the slots 85 and 86 in bottom frame 18 and then into air passages 95 and 96 between the ceramic panels and the firebox where it will then rise and exit from above the stove as heated air. Any excessive pressure in the firebox will be automatically relieved through means of the pressure plate 78 which loosely rests in the top wall 56 of the firebox.

Because the ceramic panels 12 will retain heat for a much longer period of time than cast iron or sheet steel, the logs or other fuel may be permitted to burn down to a small ash before replenishing the stove with additional fuel. If it is desired to remove ash from the firebox, one simply has to grasp the rod 124 and reciprocate it to oscillate the movable grate **72*a* for dropping ash into the pan 70 which may then be removed by opening safety door 26 and longitudinally withdrawing the pan 70**.

Although an important feature of the present invention resides in the use of ceramic material in the formation of the heat panels, the invention contains other novel features which need not be limited to the use of ceramic heat panels.

What is claimed is:

1. A firebox for a stove comprising a base, a plurality of walls upstanding from the base and a top wall defining a combustion chamber, one of said upstanding walls having an exhaust port in an upper section thereof, a pan-like flue structure attached to said one wall on the outer side thereof and defining therewith an elongated flue passage, one end of said flue structure covering said exhaust port, said flue structure extending from said one end thereof downwardly along said one wall of said firebox and terminating in an outlet located at a level below the level of the exhaust port, and a heat shield mounted relative to the firebox outwardly of said one wall and covering said flue structure, said heat shield having an opening in registry with the outlet of said flue structure.

2. The firebox defined in claim 1 wherein said flue structure includes a generally planar base and walls projecting from the base and attached to said one wall of the firebox.

3. The firebox defined in claim 2 wherein said outlet of said flue structure projects from the base thereof generally normal thereto.

4. A firebox for a stove including a base and opposite front and back side walls defining a combustion chamber, a first exhaust outlet located in an upper portion of one of said front and back walls, a flue mounted to said one wall in registry at one end with said exhaust outlet and extending from said outlet downwardly along said one wall and terminating in an outlet at an elevation substantially lower than that of said outlet in said one wall, a second exhaust outlet in an upper portion of the other of said front and back walls, and a closure plate covering the second exhaust outlet, and wherein said flue and closure plate are interchangeable between said front and back walls and the exhaust outlets therein, and there is further included a heat shield mounted relative to the firebox outwardly of said one wall and covering said flue, said heat shield having an opening in registry with the outlet of said flue.

5. The firebox defined in claim 4 further including heat panels mounted to the walls and having adjacent edge portions in lapped interrelationship.

6. The firebox defined in claim 5 wherein said combustion chamber has a width dimension and a longitudinal dimension substantially greater than the width dimension, and said firebox includes an end wall having a loading door covering the combustion chamber and facing the longitudinal dimension thereof.

7. The firebox defined in claim 5 further including grooves in said one wall receiving said flue.

* * * * *